US005240065A

United States Patent [19]

Takahashi et al.

[11] Patent Number: 5,240,065

[45] Date of Patent: Aug. 31, 1993

[54] CONTINUOUSLY CASTING AN ALUMINUM BAR HAVING A HERICAL CONTOUR

[75] Inventors: Akihiko Takahashi, Ryugasaki; Hitoshi Yasuda, Tsukuba, both of Japan

[73] Assignee: Sumitomo Chemical Company, Limited, Osaka, Japan

[21] Appl. No.: 983,473

[22] Filed: Dec. 3, 1992

Related U.S. Application Data

[63] Continuation-in-part of Ser. No. 806,217, Dec. 13, 1991, abandoned.

[30] Foreign Application Priority Data

Dec. 26, 1990 [JP] Japan ..... 2-406938

[51] Int. Cl.[5] ..... B22D 11/04; B22D 11/10

[52] U.S. Cl. ..... 164/459; 164/490

[58] Field of Search ..... 164/459, 418, 490, 440

[56] References Cited

U.S. PATENT DOCUMENTS

| | | | |
|---|---|---|---|
| 3,153,821 | 10/1964 | Menasoff | 164/417 |
| 4,168,738 | 9/1979 | Passley et al. | 164/459 |

FOREIGN PATENT DOCUMENTS

| | | | |
|---|---|---|---|
| 0138802 | 4/1985 | European Pat. Off. | 164/440 |
| 55-46265 | 11/1980 | Japan . | |
| 57-64449 | 4/1982 | Japan | 164/440 |
| 1253043 | 11/1971 | United Kingdom | 164/440 |

*Primary Examiner*—J. Reed Batten, Jr.
*Attorney, Agent, or Firm*—Stevens, Davis, Miller & Mosher

[57] ABSTRACT

Aluminum bar having a helical contour continuously cast using a mold comprising a heating unit and a cooling unit which have a groove or protrusion helically cut on the inner wall surface, and casting aluminum while conducting rotation and withdrawing in conformity with the slope of the helix.

1 Claim, 2 Drawing Sheets

CONTINUOUSLY CASTING AN ALUMINUM BAR HAVING A HERICAL CONTOUR

CROSS-REFERENCE TO RELATED APPLICATION

This application is a continuation-in-part of U.S. patent application Ser. No. 07/806,217 filed Dec. 13, 1991, and now abandoned.

BACKGROUND OF THE INVENTION

1. Field of the Invention

The present invention relates to a process for producing a continuously cast bar of aluminum which has a helical groove and is substantially free from defects on the inner and outer surfaces thereof.

2. Description of the Prior Art

For obtaining a long aluminum bar having a helical groove, there are already known, for example, a method which comprises first preparing a thick bar by casting or the like, working it into a rectilineal bar or a bar having grooves by means of an extruder, etc. and then giving a twist to the bar at its both ends, and a method which comprises grooving a helix continuously on the surface of a bar by means of rolling or the like.

There is also known a method which comprises using a mold having a helically cut groove which constitutes a part of the present invention, and producing a continuous bar having a helical groove, while conducting rotation and withdrawing in conformity with the slope of the helix (U.S. Pat. No. 4,168,738).

Although it is also possible by these conventional methods to obtain a long bar having a continuous helical groove by supplying a raw material bar continuously during the extrusion, it is difficult to avoid staining at the joint surface due to lubricant used in the extrusion or to avoid structural change, etc.

Although it is also possible to bond the respective end faces by welding or the like after completion of an extrusion, the inspection and the detection of defects, if any, at the bond portion require much time and trouble, and further the deformation of the helical groove at the bond portion necessitates complicated and difficult work for readjusting it.

Also when a heretofore known casting into a helical shape is employed, the resulting continuously cast bar of aluminum has defects such as shrinkage cavity inside the bar unavoidably, and has a lot of depressions and protuberances of its surface. Thus, such defects of the inside and surface of the cast pro duct have been unavoidable.

SUMMARY OF THE INVENTION

The present invention provides a process for continuously casting aluminum which comprises using a mold for continuous casting comprising a combined structure, which structure has a molten metal-supplying part, a cooling part and a heating unit attached to the inside or outside of the molten metal-supplying part, both the molten metal-supplying part and the cooling part having a groove or protrusion helically cut on the inner wall surface, maintaining molten aluminum at 700°-850° C. by heating the inner wall surface or the whole of the molten metal-supplying part at 700°-850° C. by means of said heating unit, and cooling the cooling part with water at 5°-50° C., casting said molten aluminum by withdrawing a body to be cast from the cooling part at a rate of 5 to 30 mm/min while rotating the same in conformity with the slope of said groove or protrusion, and thereby obtaining continuously a cast bar having a helical groove.

PREFERRED EMBODIMENTS OF THE INVENTION

Figure 1:
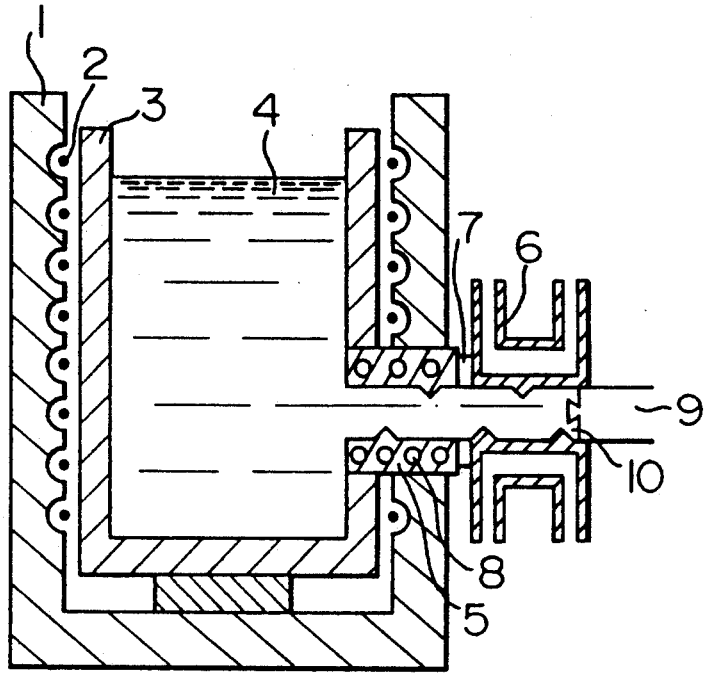
FIG. 1 is a sectional side view of a casting apparatus with combined heating and cooling units in a situation at the beginning of a continuous casting.

The present invention will be described in detail below.

Although the present invention can be applied to aluminum and its alloys, a body to be cast immediately after solidification is required to bear a shearing force caused by the rotation of the mold o the rotation of the cast body itself, so that the invention is more suitably applied to pure aluminum or systems containing a small amount of an alloy.

A helical cast bar can be obtained by withdrawing a body to be cast while rotating it in conformity with the slope of the helix. When a longer bar is to be cast, the cast body may be taken up around a jig such as a spool or bobbin while being rotated together with the jig. A cast bar having a helical groove can be also obtained continuously by drawing the cast bar while rotating the mold in conformity with the slope of the helix, instead of rotating the cast bar itself.

In the present invention, a cast bar may be rotated by, for example, rotating the mold, rotating a jig for taking up the cast bar or rotating a molten metal-holding part for supplying molten metal and the mold part as one body as well as rotating the cast bar itself.

For obtaining a long aluminum bar which has a helical groove and is substantially free from defects on the inner and outer surfaces thereof, the mold for continuous casting should be the one which can achieve unidirectional solidification in the opposite direction to the casting direction and besides in which the shape of freezing interface should be such that solidification on the surface of the cast bar is simultaneous with or delayed behind solidification at the center portion thereof.

For this purpose, molten aluminum should be maintained at 700°-850° C., preferably 750°-800° C., the mold used in the present invention should be composed of a part to be cooled at a temperature lower than the freezing temperature of aluminum with water at 5°-50° C. at the outlet of the mold and a part to be heated and maintained at 700°-850° C., and the casting rate should be 5 to 30 mm/min. It is also effective for the purpose of increasing a temperature difference between the cooling and heating parts to heighten cooling effect by, for example, pouring water directly onto the outlet side of the cooling part.

The larger the temperature difference between the heating and cooling parts, the more the unidirectional solidification is ensured. T attain this object, it is preferable to provide an insulating layer between the two parts.

The heating part can be maintained above the freezing temperature of molten aluminum by heat transferred from the molten metal-holding part, which, however, is not satisfactory for achieving complete unidirectional solidification even when a heat insulating layer is provided between the heating part and the cooling part. Therefore, the heating unit should be provided in the inside or outside of the mold. Examples of heating units usable for such purpose include one which makes use of resistance heating and one which uses induction heating.

Figure 3:
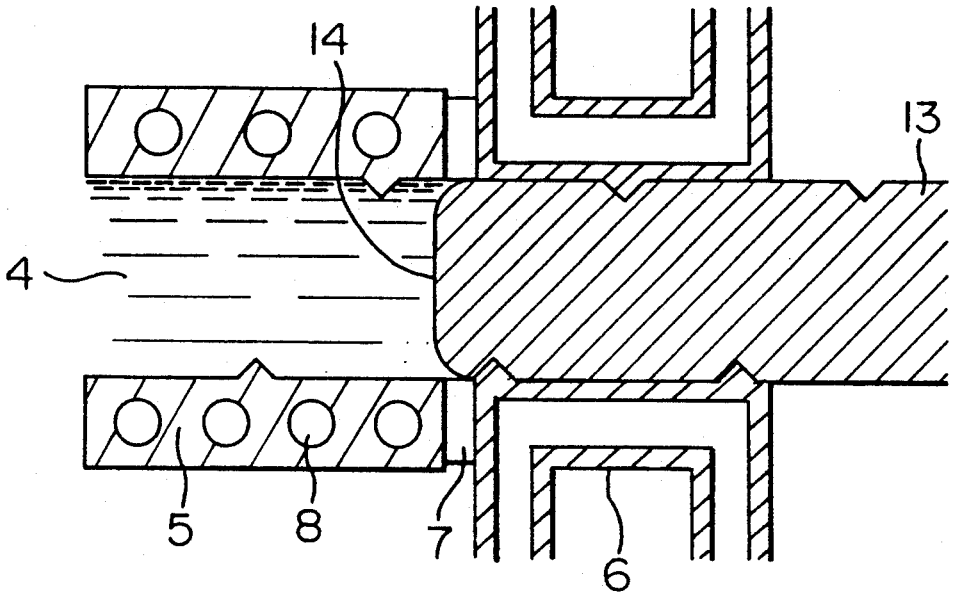
FIG. 3 shows a shape of freezing interface obtained in the production by the process of the present invention.

FIG. 3 is a detail view of the mold, and shows a shape of freezing interface 14 which is such that solidification on the surface of the cast bar is delayed behind solidification at the center portion thereof. Aluminum 4 molten in a molten metal-supplying part 5 is cooled by a mold-cooling part 6 to form a cast bar 13. In this case, solidification on the surface of the cast bar is delayed behind solidification at the center portion thereof by heating by a heating unit 8. It is difficult to obtain such a shape of freezing interface when the diameter of the cast bar is large or the purity of a raw material is low. When aluminum having a purity of 99% is used, the diameter of the cast bar is preferably 50 mm$\phi$ or less.

By conducting the continuous casting with a mold having a definite temperature gradient among a heating part, insulating part and cooling part as mentioned above, while conducting the rotation in conformity with the slope of helix, a continuously cast bar of aluminum having a helical groove without defects on its surface or inside can be easily produced through a simple process step.

Although the shape of the cross-section of the mold is basically a circle in the present invention, it is not critical and may be also any one of polygons such as triangles, etc. For example, when the cross-section of the mold is rectangular and the inner wall surface of the mold is helical, bars having helical appearance can be obtained. When the cross-section is circular, continuously cast bars having a helical groove can be obtained by use of a mold having a groove or protrusion helically cut o its inner wall surface.

The shape of the helical groove of the continuously cast bar obtainable in the present invention may be any desired one as long as it permits withdrawing of the cast bar.

EXAMPLE

FIG. 1 shows an example of a casting apparatus for embodying the process of the present invention in a situation at the beginning of casting. A molten metal-holding furnace 1 is provided with a holding furnace heating unit 2 for melting a raw material and a molten metal-holding crucible 3, and molten aluminum 4 having a purity of 99% is held therein. A combined mold attached to the side wall of the molten-metal holding crucible is composed of a graphite-made molten metal-supplying part 5 having a built-in mold-heating unit 8 for heating the mold, a copper-made mold-cooling part 6 whose inside is cooled by water and an asbestos cloth heat insulating part 7 of 1 mm thickness which prevents heat transfer between part 5 and part 6.

Although the mold is attached sideways in the present invention, subsequent operations can be conducted in completely the same manner as above also when a similar mold is attached to the bottom part of the crucible right downward. The mold has an inner diameter of 30 mm, on the inner wall of which is cut one line of helical protrusion 10 having a triangular cross-section of 5 mm height and 10 mm base length in a pitch of 60 mm.

In starting the casting, the mold needs to be plugged with a dummy block 9 so that molten aluminum may not leak out of the mold. The aluminum in the molten metal-holding furnace is maintained at 780° C. Molten aluminum with which the mold is filled freezes at the cooling part and bonds itself firmly to the dummy block. The casting is carried out while adjusting the amount of water in the mold-cooling part so as to maintain the temperature of cooling water at the outlet at 25° C. Although the solidification proceeds as far as the heat insulating part, it does not proceed farther because the heating part has been kept at 750° C. by means of a temperature controlling apparatus. Owing to cooling due to heat transfer from the freezed part, the freezing interface assumes a shape somewhat convex toward the direction of progress of the solidification, as shown in FIG. 3.

After the solidification was confirmed in the cooling part, the continuous casting was carried out at a drawing rate of 30 mm/min while rotating the dummy block and the continuously cast bar in conformity with the helical shape of the inside wall surface of the mold.

Figure 2:
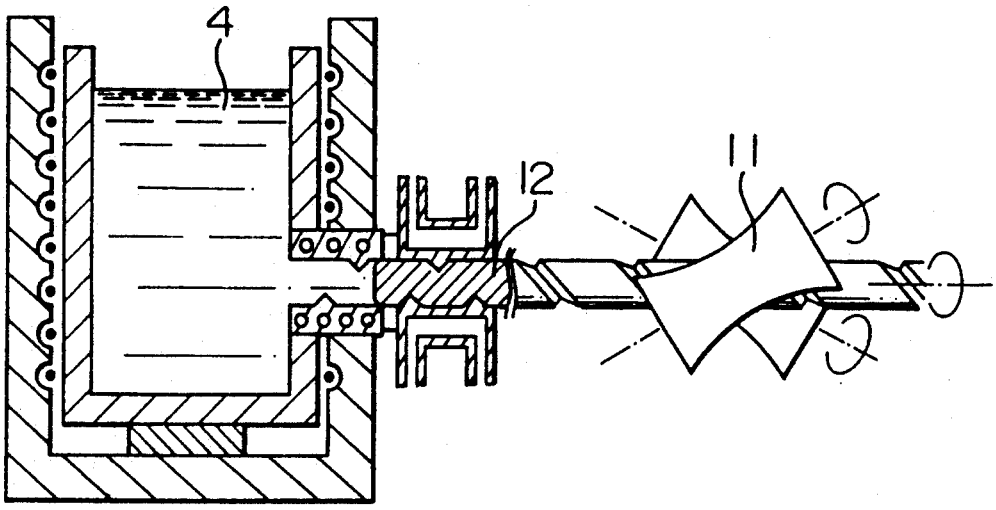
FIG. 2 is a sectional side view of a casting apparatus in casting operation and a sketch drawing of a continuously cast bar formed.

FIG. 2 shows the appearances of a pair of rolls 11 for rotational withdrawing and a continuously cast bar formed 12 having a helical groove on its outer wall.

The continuously cast bar thus obtained had an appearance of smooth, completely reproduced helix, had few depressions and protuberances of the surface, and had no defects such as shrinkage cavity inside the bar.

COMPARATIVE EXAMPLE

A continuously cast bar was obtained in the same manner as in the Example except for conducting the casting at a rate of 100 mm/min without charging the mold-heating unit 8 with electricity.

Figure 4:
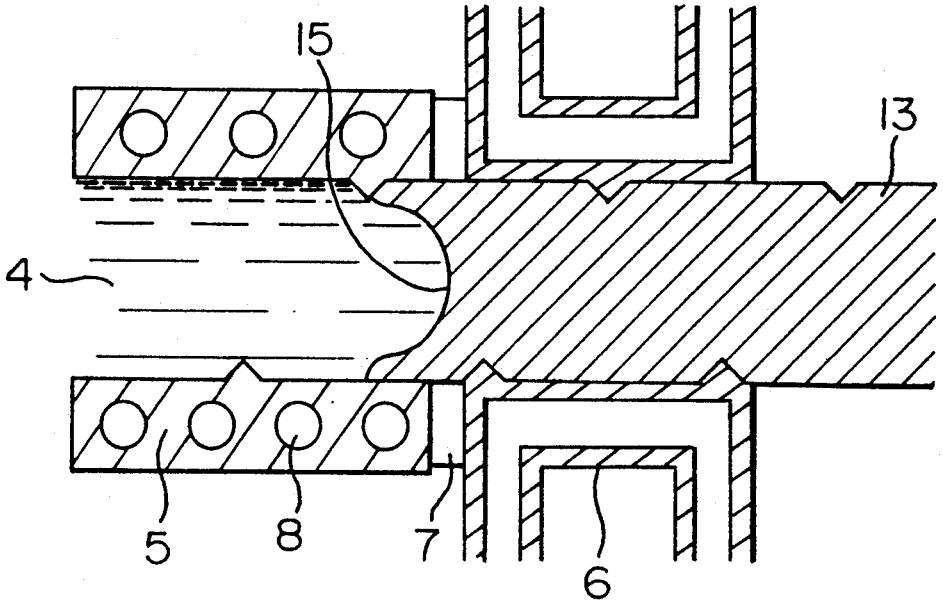
FIG. 4 shows a shape of freezing interface obtained when the heater of a mold-heating part is not used.

In this case, the surface of the cast bar is mainly cooled in the part to be frozen, and the freezing interface assumes a shape which is concave toward the direction of progress of the solidification, like the shape of freezing interface 15 shown in FIG. 4.

The continuously cast bar thus obtained had an appearance of substantially reproduced helical groove but had stripes formed in the vertical direction by the solidification.

What is claimed is:

1. A process for continuously casting aluminum which comprises supplying molten aluminum to a mold for continuous casting comprising a combined structure, which structure has a molten metal-supplying part, a cooling part and a heating unit attached to the inside or outside of the molten metal-supplying part, both the molten metal-supplying part and the cooling part having a groove or protrusion helically cut on the inner wall surface, maintaining said molten aluminum at 700°–850° C. in the molten metal supplying part by heating the inner wall surface or the whole of the molten metal-supplying part at 700°–850° C. by means of said heating unit, cooling the cooling part with water at 5°–50° C., and withdrawing a cast aluminum bar having a helical groove or protrusion from the cooling part at a rate of 5 to 30 mm/min while rotating the same in conformity with the slope of said groove or protrusion.

* * * * *